US005749300A

United States Patent [19]

Park

[11] Patent Number: 5,749,300

[45] Date of Patent: May 12, 1998

[54] TRANSFER ROLLING PROCESS AND DEVICE FOR PRODUCING BANNERS

[75] Inventor: Kyoung Ho Park, Seoul, Rep. of Korea

[73] Assignee: Whal-Sun Lee, Chungnam, Rep. of Korea

[21] Appl. No.: 740,467

[22] Filed: Oct. 29, 1996

[30] Foreign Application Priority Data

Nov. 15, 1995 [KR] Rep. of Korea ..... 41491/95

[51] Int. Cl.[6] ..... B41L 35/14

[52] U.S. Cl. ..... 101/488; 101/34

[58] Field of Search ..... 101/33, 34, 487, 101/488, 492, 137, 142, 177, 217

[56] References Cited

U.S. PATENT DOCUMENTS 2,583,286 1/1952 Albini-columbo ..... 101/488
3,646,884 3/1972 Johnson ..... 101/33
5,493,966 2/1996 Tseng ..... 101/33
5,603,259 2/1997 Gross et al. ..... 101/33

*Primary Examiner*—Ren Yan
*Attorney, Agent, or Firm*—Harrison & Egbert

[57] ABSTRACT

A transfer rolling process and device for producing banners is disclosed. In the above process, stencil letters or figures made of a transfer sheet are attached to a longitudinal transfer sheet. A banner with a white background is produced by attaching the stencil letters or figures to a white transfer sheet, while a banner with a color background is produced by attaching the stencil letters or figures to a transfer sheet of the same color as the background of the banner. The longitudinal transfer sheet is wound onto a torsionless pipe. Thereafter, paper and cloth from respective rolls pass over a heating drum at a speed of 1–3 m/min while overlapping the transfer sheet from the torsionless pipe. The heating drum in the above state is heated to a temperature of 220°–240° C., thus heating and melting the coloring agent of the stencil letters or figures and transferring the letters or figures onto the cloth.

1 Claim, 2 Drawing Sheets

TRANSFER ROLLING PROCESS AND DEVICE FOR PRODUCING BANNERS

BACKGROUND OF THE INVENTION

1. Field of the Invention

The present invention relates, in general, to a process and device for producing banners (placards) and, more particularly, to a process and device for producing banners with thermal transfer rolls.

2. Description of the Prior Art

As well known to those skilled in the art, a banner is a long piece of cloth, often stretched between two poles, with a sign printed on it. The sign of a banner generally states information concerning products, events and personal characteristics of, for example, political candidates. Such banners may be produced by several methods. For example, a banner may be simply produced by manually writing or drawing letters or figures with ink or paint on a long piece of cloth of a predetermined size. Meanwhile, when it is necessary to produce a plurality of same banners, the banners may be produced by spraying ink or paint onto cloths of the same size with a stencil, the stencil being cut with a knife or scissors in order to make letters or figures to be printed on each cloth. On the other hand, when it is necessary to produce a plurality of same banners of a small size, the banners may be produced by a printing process with a printer.

However, the banners produced in the above-mentioned methods have a problem in that the ink or paint regrettably spreads on the cloth on a day showing a high percentage of humidity or on a rainy day. Another problem of the above banners resides in that the banners have a bad appearance and the signs printed on them lack clearness. Furthermore, the above methods for producing the banners are very inefficient.

The above problems may be overcome by the use of a transfer process with transfer ink.

In order to produce a banner by a transfer process with transfer ink, a transfer sheet is cut with a knife or scissors in order to make stencil letters or figures, which are to be transferred on the banner. In a more effective process, a computer is line-processed in order to make stencil letters or figures prior to getting ready for outputting the stencil letters or figures. Thereafter, a transfer sheet is put into a computer aided cutter thus outputting the stencil letters or figures. When outputting the stencil letters or figures, the knife pressure of the cutter is appropriately adjusted so that the stencil letters or figures are precisely cut out of the inlet transfer sheet.

Thereafter, the above stencil letters or figures are uniformly arranged on a long piece of cloth or transfer sheet, which is laid on a long table. Thereafter, a thermal press is partially operated from one side to the other side while moving the table, thus producing a banner with the letters or figures transferred onto it.

However, in the above transfer process for producing the banners, the stencil letters or figures, which are arranged on the cloth or transfer sheet, may be shifted by the thermal press during the operation of the press. Therefore, the size of the transferred letters or figures on the cloth may be different from the stencil letters or figures. The transferred letters or figures also may be twisted. In order to produce a banner by the above transfer process, the partial thermal pressing process must be repeated at least five or six times resulting in the transfer process being very inefficient. In the repeated thermal pressing processes, the pressing pressure may be changed and the temperature of the press's external surface may be different from that of the internal surface, so that the banner's surface with the transferred letters or figures may fail to have a uniform color.

SUMMARY OF THE INVENTION

It is, therefore, an object of the present invention to provide a process and device for producing banners in which the above problems can be overcome and which uses thermal transfer rolls.

In one aspect, the present invention provides a process for producing a banner comprising the steps of: forming stencil letters or figures from a releasable transfer sheet and attaching the stencil letters or figures to a transfer sheet in a way such that when it is necessary to produce a banner with a white background, the stencil letters or figures are attached to a white transfer sheet, but when it is necessary to produce a banner with a color background, the stencil letters or figures are attached to a transfer sheet of the same color as the background of the banner; winding the transfer sheet with the stencil letters or figures onto a torsionless pipe in a way such that the stencil letters or figures are directed radially inward; and starting a transfer roll device in order to cause paper and cloth from respective rolls to pass over respective tension control rollers, the paper and cloth in turn being fed to a belt table and overlapping the transfer sheet from the torsionless pipe prior to passing over a heating drum at a speed of 1–3 m/min, the heating drum being heated to a temperature ranging from 220° C. to 240° C.

In another aspect, the present invention provides a transfer roll device for producing a banner comprising: a housing; paper and cloth rolls mounted to a side wall of the housing; tension control rollers installed above the paper and cloth rolls, respectively, and adapted for controlling the tension of paper and cloth unwound from the respective rolls; an endless belt passing over a belt table holding roller, a first tension roller, a heating drum, a second tension roller and a plurality of guide rollers; a longitudinal bar connected to a rotation controller and installed in front of both the belt table holding roller and the first tension roller; and a torsionless pipe fitted over the bar.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
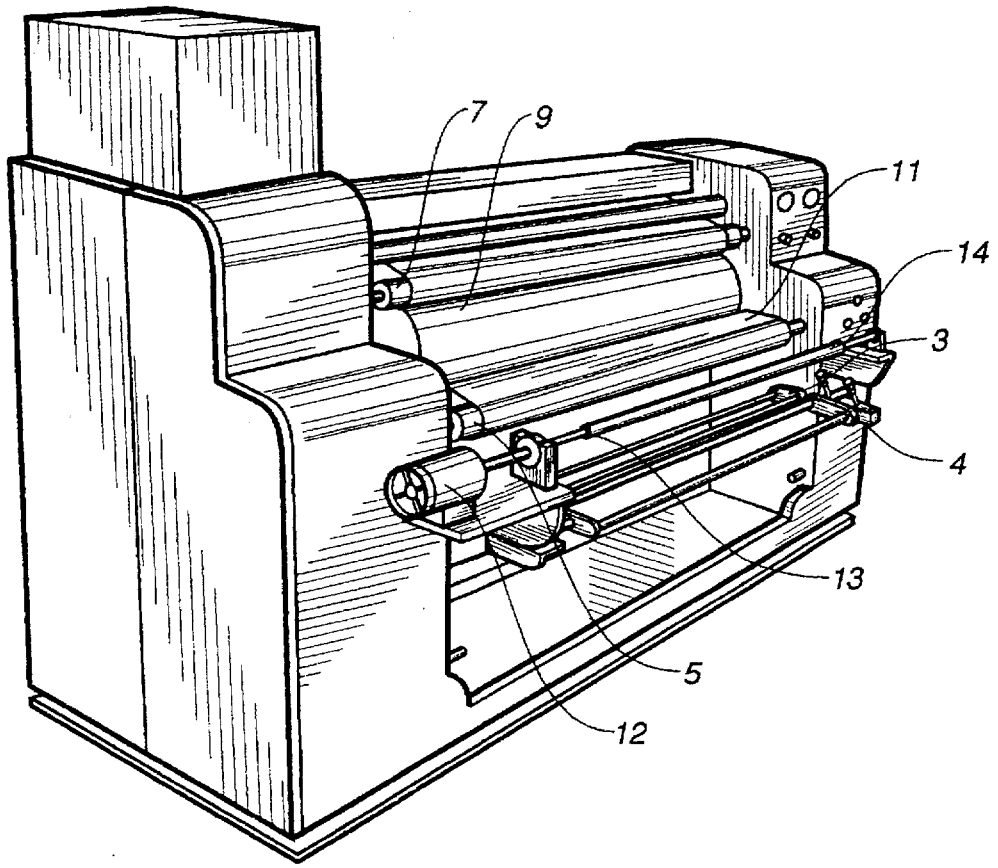
FIG. 1 is a perspective view of a transfer roll device for producing a banner in accordance with the preferred embodiment of the present invention.
Figure 2:
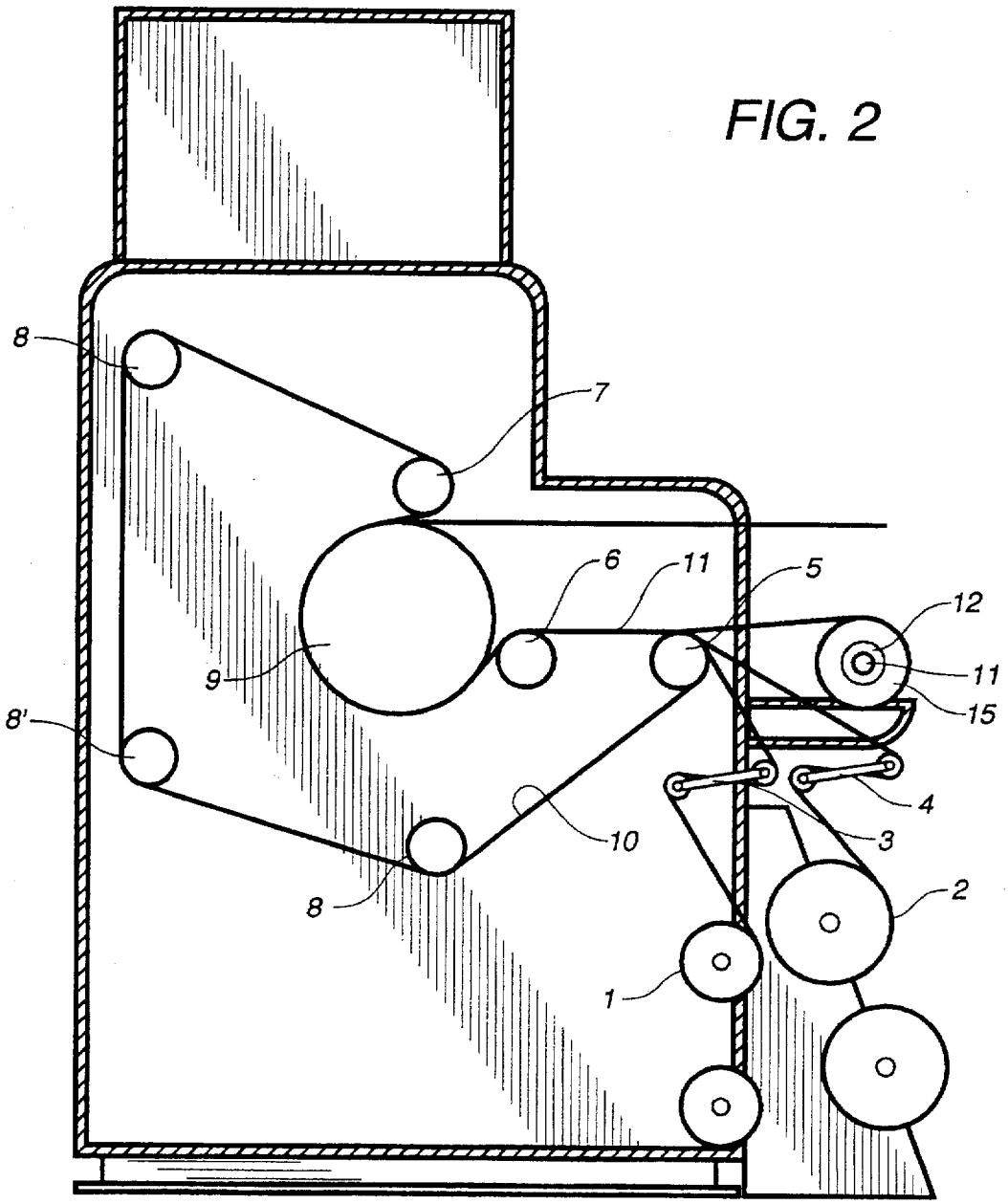
FIG. 2 is a side sectional view showing the construction of the transfer-roll device of this invention.

FIG. 1 is a perspective view of a transfer roll device for producing a banner in accordance with the preferred embodiment of the present invention. FIG. 2 is a side sectional view showing the construction of the transfer roll device of this invention.

As shown in the drawings, the transfer roll device A includes two rolls, that is, a paper roll 1 and a cloth roll 2, which are mounted to-a side wall B of a housing in the lower front section inside the housing. Two sets of tension control rollers 3 and 4 are installed above the rolls 1 and 2 and control the tension of the paper and cloth unwound from the rolls 1 and 2, respectively. An endless belt 10 passes over a belt table holding roller 5 and a first tension roller 6 prior to being introduced to a heating drum 9. The first tension roller 6 is installed around the inlet side of the heating drum 9, while a second tension roller 7 is installed around the outlet side of the drum 9. Due to the two tension rollers 6 and 7, the belt 10 comes into close contact with the drum 9 while being appropriately tensioned when the belt 10 passes over the drum 9. The belt 10 from the second tension roller 7 in turn passes over three guide rollers 8, 8' and 8" thus being guided to the belt table holding roller 5. In the above device A, the holding roller 5 and first tension roller 6 constitute a belt table 11. The above transfer roll device A also includes a torsionless pipe 14. The torsionless pipe 14 is fitted over a longitudinal bar 13, which is installed in front of the holding roller 5 and is connected to a rotation controller 12.

In order to produce a banner with the above transfer roll device A, stencil letters or figures are primarily cut out of a releasable transfer sheet in the same manner as described for the typical transfer process.

The above stencil letters or figures are, thereafter, attached to a transfer sheet or a mount sheet 15. In this case, when it is necessary to produce a banner with a white background, the stencil letters or figures are attached to a white transfer sheet. Meanwhile, when it is necessary to produce a banner with a color background, the stencil letters or figures are attached to a transfer sheet with the same color as the background. The transfer sheet 15 with the stencil letters or figures is, thereafter, wound onto the torsionless pipe 14 in a way such that the stencil letters or figures is directed radially inward. After winding the transfer sheet 15 onto the torsionless pipe 14, the transfer roll device A is started. When starting the device A, the paper and cloth are unwound from the respective rolls 1 and 2 and in turn pass over the respective sets of tension control rollers 3 and 4 prior to being commonly fed to the holding roller 5 of the belt table 11. At the holding roller 5 of the belt table 11, the paper and cloth overlap the transfer sheet 15 unwound from the torsionless pipe 14. The paper and cloth overlapping the transfer sheet 15 in turn pass over the heating drum 9 at a speed of 1–3 m/min. In this case, the heating drum 9 is heated to a temperature ranging from 220° C. to 240° C.

In accordance with the present invention, the transfer sheet or the mount sheet 15, onto which the stencil letters or figures are attached, is formed by impregnating hot melt resin-type ink or dye to a sheet, while the releasable transfer sheet used for forming the stencil letters or figures is formed by coating a releasable adhesive film onto one surface of a transfer sheet prior to attaching a releasable paper to the coated surface of the transfer sheet. It should be understood that it is not preferred to use a highly adhesive bonding agent when attaching the stencil letters or figures to the mount sheet 15 because it is almost impossible to change the position of such stencil letters or figures on the mount sheet 15.

The stencil letters or figures, which are coated with a highly adhesive bonding agent, may cause the mount sheet 15 to be torn or damaged when the position of the stencil letters or figures on the mount sheet 15 is changed. In this regard, it is preferable to use stencil letters or figures cut out of a releasable transfer sheet as described above.

In the above transfer roll device, the paper from the paper roll 1 is used for preventing any contamination of the endless belt 10 during the transfer process. While the paper and cloth overlapping the transfer sheet 15 pass over the heating drum 9, a coloring agent of the stencil letters or figures attached to the transfer sheet 15 is heated by the heating drum 9 and is melted and transferred to the cloth, thus producing a banner with desired letters or figures.

When the paper, cloth and transfer sheet 15 are output from the heating drum 9, they overlap together in order from top to bottom the paper, cloth and transfer sheet 15.

In the above transfer roll device A, the belt table 11 allows a worker to array the paper, cloth and transfer sheet 15 and adjust the position of them when they are twisted. During the transfer process, the torsionless pipe 14 moves horizontally in order to adjust the twisted and rumpled transfer sheet with the stencil letters or figures and flatten the paper and cloth unwound from the rolls 1 and 2. Meanwhile, the tension control rollers 3 and 4 control the feeding rate and stencil force of the paper and cloth, which have different characteristics.

As described above, the present invention provides a transfer rolling process and device for producing banners. In the process and device of this invention, the stencil letters or figures made of a releasable transfer sheet are transferred to a cloth of a banner with a uniform pressure. The stencil letters or figures in the transfer roll device of this invention are clearly and precisely transferred onto the cloth and are uniformly colored thus providing good banners. Another advantage of this invention resides in that the transfer rolling process for producing banners is an integrated process with improved work efficiency.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A process for producing a banner comprising the steps of:

forming stencil letters or figures from a releasable transfer sheet and attaching said stencil letters or figures to a transfer sheet in a way such that when it is necessary to produce a banner with a white background, the stencil letters or figures are attached to a white transfer sheet, but when it is necessary to produce a banner with a color background, the stencil letters or figures are attached to a transfer sheet of the same color as the background of the banner;

winding said transfer sheet with the stencil letters or figures onto a torsionless pipe in a way such that the stencil letters or figures are directed radially inward;

starting a transfer roll device in order to cause paper and cloth from respective rolls to pass over respective tension control rollers, said paper and cloth in turn being fed to a belt table and overlapping the transfer sheet from said torsionless pipe prior to passing over a heating drum at a speed of 1–3 m/min, said heating drum being heated to a temperature ranging from 220° C. to 240° C.

* * * * *